US011339491B2

(12) United States Patent
Nakagawa et al.

(10) Patent No.: US 11,339,491 B2
(45) **Date of Patent: *May 24, 2022**

(54) STEEL SHEET FOR CANS, AND PRODUCTION METHOD THEREFOR

(71) Applicant: JFE STEEL CORPORATION, Tokyo (JP)

(72) Inventors: Yusuke Nakagawa, Tokyo (JP); Takeshi Suzuki, Tokyo (JP); Mikito Suto, Tokyo (JP); Katsumi Kojima, Tokyo (JP); Yuya Baba, Tokyo (JP); Hanyou Sou, Tokyo (JP); Yoichiro Yamanaka, Tokyo (JP); Shunsuke Tokui, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 153 days.

This patent is subject to a terminal disclaimer.

(21) Appl. No.: 16/619,147

(22) PCT Filed: Jun. 5, 2018

(86) PCT No.: PCT/JP2018/021548
§ 371 (c)(1),
(2) Date: Dec. 4, 2019

(87) PCT Pub. No.: WO2018/225726
PCT Pub. Date: Dec. 13, 2018

(65) Prior Publication Data

US 2020/0141021 A1 May 7, 2020

(30) Foreign Application Priority Data

Jun. 9, 2017 (JP) ..... JP2017-114531

(51) Int. Cl.
*C25D 3/04* (2006.01)
*C23C 28/00* (2006.01)
(Continued)

(52) U.S. Cl.
CPC ..... *C25D 3/04* (2013.01); *C23C 28/32* (2013.01); *C25D 5/18* (2013.01); *C25D 5/605* (2020.08);
(Continued)

(58) Field of Classification Search
None
See application file for complete search history.

(56) References Cited

U.S. PATENT DOCUMENTS 4,687,713 A * 8/1987 Ogata ..... C25D 11/38 428/628
10,753,005 B2 * 8/2020 Nakagawa ..... C25D 3/08
(Continued)

FOREIGN PATENT DOCUMENTS

CN 86 1 02555 A 12/1986
EP 0 194 654 A1 9/1986
(Continued)

OTHER PUBLICATIONS

Aug. 21, 2020 Office Action issued in U.S. Appl. No. 16/060,206.
(Continued)

*Primary Examiner* — Shamim Ahmed
*Assistant Examiner* — Bradford M Gates
(74) *Attorney, Agent, or Firm* — Oliff PLC

(57) ABSTRACT

A steel sheet for cans which exhibits excellent weldability; and a production method therefor include a steel sheet for cans with the surface of a steel sheet in order from the steel sheet side, a chromium metal layer and a hydrous chromium oxide layer. The deposited amount of the chromium metal layer is 65-200 mg/m$^2$. The deposited amount of the hydrous
(Continued)

chromium oxide layer in terms of chromium is 3-30 mg/m$^2$. The chromium metal layer includes: a base part having a thickness of 7.0 nm or higher; and granular protrusions which are on the base part, have a maximum grain size of 100 nm or lower, and have a number density per unit area of at least 200 per μm$^2$.

6 Claims, 1 Drawing Sheet

(51) Int. Cl.

| | |
|---|---|
| ***C25D 11/38*** | (2006.01) |
| ***C25D 5/00*** | (2006.01) |
| ***C25D 5/18*** | (2006.01) |
| *C25D 7/00* | (2006.01) |

(52) U.S. Cl.
CPC ..... *C25D 5/617* (2020.08); *C25D 5/627* (2020.08); *C25D 11/38* (2013.01); *C25D 7/00* (2013.01)

(56) References Cited

U.S. PATENT DOCUMENTS

| | | | | |
|---|---|---|---|---|
| 10,914,016 | B2 * | 2/2021 | Nakagawa ..... | C25D 5/14 |
| 10,968,528 | B2 * | 4/2021 | Nakagawa ..... | C25D 7/00 |
| 2018/0355496 | A1 | 12/2018 | Nakagawa et al. | |
| 2018/0363160 | A1 | 12/2018 | Nakagawa et al. | |

FOREIGN PATENT DOCUMENTS

| | | | |
|---|---|---|---|
| GN | 85 1 01586 | A | 1/1987 |
| JP | S61-281899 | A | 12/1986 |
| JP | S63-186894 | A | 8/1988 |
| JP | H01-096397 | A | 4/1989 |
| JP | H03-177599 | A | 8/1991 |
| JP | H03-229897 | A | 10/1991 |
| JP | H04-187797 | A | 7/1992 |
| JP | H05-70996 | A | 3/1993 |
| JP | H05-287591 | A | 11/1993 |
| JP | H11-189898 | A | 7/1999 |
| WO | 2017/098991 | A1 | 6/2017 |
| WO | 2017/098994 | A1 | 6/2017 |

OTHER PUBLICATIONS

May 31, 2021 Office Action issued in Chinese Patent Application No. 201880036898.4.
Aug. 28, 2020 Office Action issued in Australian Patent Application No. 2018279407.
Sep. 4, 2020 Office Action issued in U.S. Appl. No. 16/619,234.
Aug. 28, 2018 International Search Report issued in International Patent Application No. PCT/JP2018/021548.
May 28, 2019 Office Action issued in Japanese Patent Application No. 2018-549585.
Apr. 10, 2019 Office Action issued in Taiwanese Patent Application No. 107119745.
Feb. 19, 2020 Search Report issued in European Patent Application No. 18813902.6.
Mar. 26, 2020 Office Action issued in U.S. Appl. No. 16/061,079.

* cited by examiner

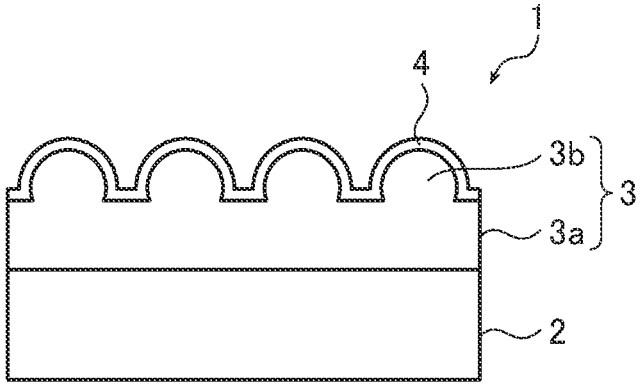
1
4
3b
3
3a
2

STEEL SHEET FOR CANS, AND PRODUCTION METHOD THEREFOR

TECHNICAL FIELD

The present invention relates to a tin mill black plate and a method of manufacturing the same.

BACKGROUND ART

Cans, which serve as containers for beverages and foods, are useful for storing the contents over a long period of time and are therefore used all over the world. Cans are roughly classified into the following two types: a two-piece can that is obtained by subjecting a metal sheet to drawing, ironing, stretching and bending to integrally form a can bottom and a can body and then joining the can body with a top lid by seaming; and a three-piece can that is obtained by machining a metal sheet into a tubular shape, welding the tubular metal sheet by a wire seam process to form a can body, and then joining the opposite ends of the can body separately with lids by seaming.

Conventionally, a tin-plated steel sheet (so-called tin plate) has been widely used as a tin mill black plate.

Nowadays, an electrolytic chromate treated steel sheet (hereinafter also called tin free steel (TFS)) having a chromium metal layer and a hydrated chromium oxide layer is expanding its range of application because it costs much less and is more excellent in paint adhesion than tin plates.

In connection with reduction in washing waste liquid and $CO_2$ for environmental reasons, cans using a steel sheet laminated with an organic resin film such as PET (polyethylene terephthalate) is drawing attention as an alternative technique that enables a coating process and a subsequent baking process to be omitted. Also in this context, the use of TFS having excellent adhesion to an organic resin film is expected to continuously expand.

However, TFS is sometimes inferior in weldability to a tin plate. This is because, due to bake hardening treatment after painting or heat treatment after lamination of an organic resin film, a hydrated chromium oxide layer in the surface layer initiates a dehydration condensation reaction, and this leads to increased contact resistance. In particular, bake hardening treatment after painting requires a higher temperature than heat treatment after lamination of an organic resin film, and therefore tends to result in poorer weldability.

Accordingly, for TFS at present, a hydrated chromium oxide layer is mechanically polished and removed immediately before welding to thereby make welding possible.

In industrial production, however, there are many problems in that, for instance, metal powder generated through polishing may be mixed in the contents, a burden of maintenance such as cleaning of can manufacturing equipment increases, and the risk of a fire caused by metal powder increases.

To cope with it, a technique for welding TFS without polishing is proposed by, for instance, Patent Literature 1.

CITATION LIST

Patent Literature

Patent Literature 1: JP 03-177599 A

SUMMARY OF INVENTION

Technical Problems

In the technique disclosed by Patent Literature 1, anodic electrolysis treatment is carried out between prior-stage and posterior-stage cathodic electrolysis treatments to thereby form a large number of defect portions in a chromium metal layer, and then chromium metal is formed into a shape of granular protrusions through the posterior-stage cathodic electrolysis treatment.

According to this technique, it is expected that in welding, the granular protrusions of chromium metal destroy a hydrated chromium oxide layer that is a factor hindering welding in the surface layer, thereby reducing contact resistance and improving weldability.

However, the present inventors studied tin mill black plate specifically described in Patent Literature 1 and found that, in some cases, the weldability was insufficient.

An object of the present invention is therefore to provide a tin mill black plate having excellent weldability and a method of manufacturing the same.

Solution to Problems

The present inventors have made an intensive study to achieve the above-described object and as a result found that higher density of granular protrusions in a chromium metal layer improves weldability of a tin mill black plate. The present invention has been thus completed.

Specifically, the present invention provides the following [1] to [6].

[1] A tin mill black plate comprising, on a surface of a steel sheet, a chromium metal layer and a hydrated chromium oxide layer stacked in this order from a steel sheet side, wherein the chromium metal layer has a coating weight of 65 to 200 mg/m$^2$, wherein the hydrated chromium oxide layer has a coating weight of 3 to 30 mg/m$^2$ in terms of chromium amount, and wherein the chromium metal layer includes a base portion with a thickness of not less than 7.0 nm and granular protrusions provided on the base portion and having a maximum diameter of not more than 100 nm and a number density per unit area of not less than 200 protrusions/μm$^2$.

[2] The tin mill black plate according to [1] above, wherein the hydrated chromium oxide layer has a coating weight of more than 15 mg/m$^2$ but not more than 30 mg/m$^2$ in terms of chromium amount.

[3] The tin mill black plate according to [1] or [2] above, wherein the granular protrusions have a number density per unit area of not less than 300 protrusions/μm$^2$.

[4] A tin mill black plate manufacturing method for obtaining the tin mill black plate according to any one of [1] to [3] above by use of an aqueous solution that contains Cr in an amount of not less than 0.50 mol/L and F in an amount of more than 0.10 mol/L and is free of sulfuric acid except for sulfuric acid inevitably incorporated therein, the method comprising:

the step of subjecting a steel sheet to treatment 1 including cathodic electrolysis treatment C1 using the aqueous solution; and the step of subjecting the steel sheet having undergone the cathodic electrolysis treatment C1 to treatment 2 including anodic electrolysis treatment A1 and cathodic electrolysis treatment C2 following the anodic electrolysis treatment A1, using the aqueous solution, at least two times.

[5] The tin mill black plate manufacturing method according to [4] above, wherein a current density of the anodic electrolysis treatment A1 is not less than 0.1 A/dm$^2$ but less than 5.0 A/dm$^2$, and wherein an electric quantity density of the anodic electrolysis treatment A1 is not less than 0.1 C/dm$^2$ but less than 5.0 C/dm$^2$.

[6] The tin mill black plate manufacturing method according to [4] or [5] above, wherein the aqueous solution used in the cathodic electrolysis treatment C1, the anodic electrolysis treatment A1 and the cathodic electrolysis treatment C2 comprises only one type of aqueous solution.

Advantageous Effects of Invention

The present invention provides a tin mill black plate having excellent weldability and a method of manufacturing the same.

BRIEF DESCRIPTION OF DRAWINGS

FIG. 1 is a cross-sectional view schematically showing one example of a tin mill black plate of the invention.

DESCRIPTION OF EMBODIMENTS

[Tin Mill Black Plate]

FIG. 1 is a cross-sectional view schematically showing one example of a tin mill black plate of the invention.

As shown in FIG. 1, a tin mill black plate 1 includes a steel sheet 2. The tin mill black plate 1 further includes, on a surface of the steel sheet 2, a chromium metal layer 3 and a hydrated chromium oxide layer 4 stacked in this order from the steel sheet 2 side.

The chromium metal layer 3 includes a base portion 3*a* covering the steel sheet 2 and granular protrusions 3*b* provided on the base portion 3*a*. The base portion 3*a* has a thickness of at least 7.0 nm. The granular protrusions 3*b* have a maximum diameter of not more than 100 nm and a number density per unit area of not less than 200 protrusions/pmt. The chromium metal layer 3 including the base portion 3*a* and the granular protrusions 3*b* has a coating weight of 65 to 200 mg/m$^2$.

The hydrated chromium oxide layer 4 is disposed on the chromium metal layer 3 to conform the shape of the granular protrusions 3*b*. The hydrated chromium oxide layer 4 has a coating weight of 3 to 30 mg/m$^2$ in terms of chromium amount.

The coating weight refers to the coating weight per one side of the steel sheet.

The constituent elements of the invention are described in detail below.

<Steel Sheet>

The type of the steel sheet is not particularly limited. In general, steel sheets used as materials for containers (e.g., a low carbon steel sheet and an ultra low carbon steel sheet) can be used. A manufacturing method of the steel sheet, a material thereof and the like are also not particularly limited. The steel sheet is manufactured through a process starting with a typical billet manufacturing process, followed by such processes as hot rolling, pickling, cold rolling, annealing and temper rolling.

<Chromium Metal Layer>

The tin mill black plate of the invention has a chromium metal layer on a surface of the foregoing steel sheet.

The role of chromium metal in typical TFS is to reduce the exposure of a surface of the steel sheet serving as the base material and thereby improve corrosion resistance. When the amount of chromium metal is too small, the steel sheet is inevitably exposed, and this may lead to poor corrosion resistance.

The coating weight of the chromium metal layer is not less than 65 mg/m$^2$ because this leads to excellent corrosion resistance of the tin mill black plate, and is preferably not less than 70 mg/m$^2$ and more preferably not less than 80 mg/m$^2$ because this leads to further excellent corrosion resistance.

In contrast, when the amount of chromium metal is too large, high-melting chromium metal is to cover the entire surface of the steel sheet, and this induces significant decrease in weld strength in welding and significant generation of dust, which may lead to poor weldability.

The coating weight of the chromium metal layer is not more than 200 mg/m$^2$ because this leads to excellent weldability of the tin mill black plate, and is preferably not more than 180 mg/m$^2$ and more preferably not more than 160 mg/m$^2$ because this leads to further excellent weldability.

«Measurement Methods of Coating Weights»

The coating weight of the chromium metal layer and the coating weight of the hydrated chromium oxide layer (described later) in terms of chromium amount are measured as follows.

First, for the tin mill black plate having formed thereon the chromium metal layer and the hydrated chromium oxide layer, the amount of chromium (total amount of chromium) is measured with an X-ray fluorescence device. Next, the tin mill black plate is subjected to alkaline treatment, i.e., is immersed in 6.5N—NaOH at 90° C. for 10 minutes, and then, again, the amount of chromium (amount of chromium after alkaline treatment) is measured with an X-ray fluorescence device. The amount of chromium after alkaline treatment is taken as the coating weight of the chromium metal layer.

Thereafter, the equation (amount of alkali-soluble chromium)=(total amount of chromium)−(amount of chromium after alkaline treatment) is calculated, and the amount of alkali-soluble chromium is taken as the coating weight of the hydrated chromium oxide layer in terms of chromium amount.

The chromium metal layer as above includes a base portion and granular protrusions provided on the base portion.

Next, those portions included in the chromium metal layer are described in detail.

«Base Portion of Chromium Metal Layer»

The base portion of the chromium metal layer mainly serves to improve corrosion resistance by covering a surface of the steel sheet.

The base portion of the chromium metal layer in the invention needs to have, in addition to corrosion resistance which is generally required of TFS, a uniform and sufficient thickness such that the base portion is not destroyed by the granular protrusions provided in the surface layer, thus preventing the exposure of the steel sheet, when the tin mill black plate inevitably comes into contact with another tin mill black plate at handling.

In connection with this, the present inventors conducted a rubbing test of a tin mill black plate with another tin mill black plate so as to check rust resistance and as a result found that, when the base portion of the chromium metal layer has a thickness of not less than 7.0 nm, the rust resistance is excellent. More specifically, the thickness of the base portion of the chromium metal layer is not less than 7.0 nm because this leads to excellent rust resistance of the tin mill black plate, and is preferably not less than 9.0 nm and more preferably not less than 10.0 nm because this leads to further excellent rust resistance.

The upper limit of the thickness of the base portion of the chromium metal layer is not particularly limited and is, for instance, not more than 20.0 nm and preferably not more than 15.0 nm.

(Measurement Method of Thickness)

The thickness of the base portion of the chromium metal layer is measured as follows.

First, a cross section sample of a tin mill black plate having formed thereon a chromium metal layer and a hydrated chromium oxide layer is produced by a focused ion beam (FIB) method and observed at a magnification of 20,000× with a scanning transmission electron microscope (TEM). Next, in a sectional shape observation on a bright-field image, focusing on a portion where only a base portion is present with no granular protrusions, a line analysis is conducted by energy dispersive X-ray spectrometry (EDX) to obtain intensity curves (horizontal axis: distance, vertical axis: intensity) of chromium and iron, and those curves are used to determine the thickness of the base portion. To be more specific, in the chromium intensity curve, the point at which the intensity is 20% of the maximum is taken as the uppermost layer, while the cross point with the iron intensity curve is taken as the boundary point with iron, and the distance between those two points is taken as the thickness of the base portion.

The coating weight of the base portion of the chromium metal layer is preferably not less than 10 mg/m$^2$, more preferably not less than 30 mg/m$^2$ and even more preferably not less than 40 mg/m$^2$ because this leads to excellent rust resistance of the tin mill black plate.

«Granular Protrusions of Chromium Metal Layer»

The granular protrusions of the chromium metal layer are formed on a surface of the base portion described above, and mainly serve to improve weldability by reducing contact resistance between to-be-welded portions of the tin mill black plate. The assumed mechanism of reduction in contact resistance is described below.

The hydrated chromium oxide layer covering the chromium metal layer is a non-conductive coating and therefore has higher electric resistance than chromium metal, so that the hydrated chromium oxide layer works as a factor hindering welding. By forming the granular protrusions on a surface of the base portion of the chromium metal layer, the granular protrusions act to destroy the hydrated chromium oxide layer using the surface pressure applied when to-be-welded portions of the tin mill black plate come into contact with each other in welding, and the granular protrusions become current-carrying points of welding current, whereby the contact resistance greatly decreases.

When the number of the granular protrusions of the chromium metal layer is too small, current-carrying points in welding decrease in number, and this may prevent the contact resistance from being lowered, resulting in poor weldability. When the granular protrusions are formed to be present at high density, the contact resistance is lowered even if the hydrated chromium oxide layer, which is an insulating layer, is thick. Thus, the paint adhesion, the under film corrosion resistance, the weldability and other properties can be achieved in good balance.

The number density of the granular protrusions per unit area is not less than 200 protrusions/μm$^2$ because this leads to excellent weldability of the tin mill black plate, and is preferably not less than 300 protrusions/μm$^2$, more preferably not less than 1,000 protrusions/μm$^2$ and even more preferably more than 1,000 protrusions/μm$^2$ because this leads to further excellent weldability.

Because too high a number density of the granular protrusions per unit area may affect the color tone or the like, the upper limit of the number density per unit area is preferably not more than 10,000 protrusions/μm$^2$, more preferably not more than 5,000 protrusions/μm$^2$, even more preferably not more than 1,000 protrusions/μm$^2$ and particularly preferably not more than 800 protrusions/μm$^2$ in order to achieve further excellent surface appearance of the tin mill black plate.

The present inventors found that, when the maximum diameter of the granular protrusions of the chromium metal layer is too large, this affects the hue or the like of the tin mill black plate, and a brown pattern appears in some cases, resulting in a poor surface appearance. The possible reasons of the above are for example as follows: the granular protrusions absorb short-wavelength (blue) light, and accordingly, reflected light thereof is attenuated, so that a reddish brown color appears; the granular protrusions diffuse reflected light, so that the overall reflectance decreases and the color gets darker.

Therefore, the maximum diameter of the granular protrusions of the chromium metal layer is set to 100 nm or less. As a result, the tin mill black plate can have an excellent surface appearance. This is probably because the granular protrusions with a smaller diameter serve to suppress absorption of short-wavelength light and suppress dispersion of reflected light.

The maximum diameter of the granular protrusions of the chromium metal layer is preferably not more than 80 nm, more preferably not more than 50 nm and even more preferably not more than 30 nm because this leads to a further excellent surface appearance of the tin mill black plate.

The lower limit of the maximum diameter is not particularly limited and is preferably, for instance, not less than 10 nm.

(Measurement Methods of Diameter of Granular Protrusions and Number Density Thereof per Unit Area)

The diameter of the granular protrusions of the chromium metal layer and the number density thereof per unit area are measured as follows.

First, a surface of the tin mill black plate having formed thereon the chromium metal layer and the hydrated chromium oxide layer is subjected to carbon deposition to produce an observation sample by an extraction replica method. Subsequently, a micrograph of the sample is taken at a magnification of 20,000× with a scanning transmission electron microscope (TEM), the taken micrograph is binarized using software (trade name: ImageJ) and subjected to image analysis, and the diameter (as a true circle-equivalent value) and the number density per unit area are determined through back calculation from the area occupied by the granular protrusions. The maximum diameter is the diameter that is maximum in observation fields as obtained by taking micrographs of five fields at a magnification of 20,000×, and the number density per unit area is the average of number densities of the five fields.

<Hydrated Chromium Oxide Layer>

A hydrated chromium oxide is deposited along with chromium metal on a surface of the steel sheet and mainly serves to improve corrosion resistance. A hydrated chromium oxide also serves to improve both corrosion resistance after painting, such as under film corrosion resistance, and paint adhesion. The coating weight of the hydrated chromium oxide layer in terms of chromium amount is not less than 3 mg/m$^2$ in order to ensure corrosion resistance and paint adhesion of the tin mill black plate, and is preferably not less than 10 mg/m$^2$ and more preferably more than 15 mg/m$^2$ because this leads to further excellent corrosion resistance and paint adhesion.

Meanwhile, a hydrated chromium oxide is inferior to chromium metal in conductivity, and accordingly, too much amount of hydrated chromium oxide leads to excessive resistance in welding, which may cause generation of dust, occurrence of splash, and a variety of weld defects such as blowhole formation associated with overwelding, thus resulting in poor weldability of the tin mill black plate.

Therefore, the coating weight of the hydrated chromium oxide layer in terms of chromium amount is not more than 30 mg/m$^2$ because this leads to excellent weldability of the tin mill black plate, and is preferably not more than 25 mg/m$^2$ and more preferably not more than 20 mg/m$^2$ because this leads to further excellent weldability.

The measurement method of the coating weight of the hydrated chromium oxide layer in terms of chromium amount is as described above.

[Tin Mill Black Plate Manufacturing Method]

Next, the tin mill black plate manufacturing method according to the present invention is described.

The tin mill black plate manufacturing method according to the present invention (hereinafter also simply called "manufacturing method of the invention") is a method of manufacturing the foregoing tin mill black plate of the invention by use of an aqueous solution that contains Cr in an amount of not less than 0.50 mol/L and F in an amount of more than 0.10 mol/L and is free of sulfuric acid except for sulfuric acid inevitably incorporated therein, the method comprising: the step of subjecting a steel sheet to treatment 1 including cathodic electrolysis treatment C1 using the aqueous solution; and the step of subjecting the steel sheet having undergone the cathodic electrolysis treatment C1 to treatment 2 including anodic electrolysis treatment A1 and cathodic electrolysis treatment C2 following the anodic electrolysis treatment A1, using the aqueous solution, at least two times.

Typically, in cathodic electrolysis treatment in an aqueous solution containing a hexavalent chromium compound, a reduction reaction occurs at a steel sheet surface, whereby chromium metal is deposited, and a hydrated chromium oxide that is an intermediate product before becoming chromium metal is deposited on the chromium metal surface. This hydrated chromium oxide is unevenly dissolved through intermittent electrolysis treatment or long time immersion in an aqueous solution of a hexavalent chromium compound, and in the subsequent cathodic electrolysis treatment, granular protrusions of chromium metal are formed.

Since the anodic electrolysis treatment is carried out between the two cathodic electrolysis treatments, chromium metal is dissolved over the entire surface of the steel sheet at multiple sites, and those sites become starting points of formation of the granular protrusions of chromium metal in the subsequent cathodic electrolysis treatment. The base portion of the chromium metal layer is deposited in the cathodic electrolysis treatment C1 before the anodic electrolysis treatment A1, and the granular protrusions of the chromium metal layer are deposited in the cathodic electrolysis treatment C2 after the anodic electrolysis treatment A1.

The amounts of deposition of those portions can be controlled by electrolysis conditions in the respective electrolysis treatments.

The aqueous solution and the electrolysis treatments used in the manufacturing method of the invention are described in detail below.

<Aqueous Solution>

The aqueous solution used in the manufacturing method of the invention is an aqueous solution that contains Cr in an amount of not less than 0.50 mol/L and F in an amount of more than 0.10 mol/L and is free of sulfuric acid except for sulfuric acid inevitably incorporated therein.

The amount of F in the aqueous solution influences dissolution of hydrated chromium oxide during immersion and dissolution of chromium metal during the anodic electrolysis treatment, and thus greatly influences the form of chromium metal deposited in the subsequent cathodic electrolysis treatment. Sulfuric acid also brings about the same effect; however, the effect generated by sulfuric acid is excessive, and as a consequence, uneven dissolution of hydrated chromium oxide causes local formation of huge granular protrusions, and dissolution of chromium metal extremely proceeds during the anodic electrolysis treatment. Thus, it may be difficult to form fine granular protrusions. Therefore, the aqueous solution in the invention is free of sulfuric acid except for sulfuric acid inevitably incorporated therein.

Sulfuric acid is inevitably incorporated in certain raw materials such as chromium trioxide in the industrial production process, so that the use of such raw materials results in inevitable incorporation of sulfuric acid into the resulting aqueous solution. The amount of sulfuric acid inevitably incorporated in the aqueous solution is preferably less than 0.0010 mol/L and more preferably less than 0.0001 mol/L.

The aqueous solution in the invention contains Cr in an amount of not less than 0.50 mol/L because this leads to highly efficient and stable deposition of chromium metal over a long period of time.

In addition, the aqueous solution in the invention contains F in an amount of more than 0.10 mol/L. As a result, even and fine dissolution of chromium metal proceeds over the entire surface during the anodic electrolysis treatment A1, and consequently, generation sites at which fine granular protrusions are generated in the cathodic electrolysis treatment C2 can be obtained.

It is preferable that one type of aqueous solution be solely used in the cathodic electrolysis treatment C1, the anodic electrolysis treatment A1 and the cathodic electrolysis treatment C2.

«Hexavalent Chromium Compound»

The aqueous solution preferably contains a hexavalent chromium compound. The hexavalent chromium compound contained in the aqueous solution is not particularly limited, and examples thereof include chromium trioxide ($CrO_3$), dichromates such as potassium dichromate ($K_2Cr_2O_7$), and chromates such as potassium chromate ($K_2CrO_4$).

The hexavalent chromium compound content of the aqueous solution is preferably from 0.50 to 5.00 mol/L and more preferably from 0.50 to 3.00 mol/L in the amount of Cr.

«Fluorine-Containing Compound»

The aqueous solution preferably contains a fluorine-containing compound. The fluorine-containing compound contained in the aqueous solution is not particularly limited, and examples thereof include hydrofluoric acid (HF), potassium fluoride (KF), sodium fluoride (NaF), hydrosilicofluoric acid ($H_2SiF_6$) and/or salts thereof. Examples of salts of hydrosilicofluoric acid include sodium silicofluoride ($Na_2SiF_6$), potassium silicofluoride ($K_2SiF_6$), and ammonium silicofluoride ($(NH_4)_2SiF_6$).

The fluorine-containing compound content of the aqueous solution is preferably more than 0.10 mol/L but not more than 4.00 mol/L, more preferably from 0.15 to 3.00 mol/L and still more preferably from 0.20 to 2.00 mol/L in the amount of F.

The temperature of the aqueous solution in each electrolysis treatment is preferably 20° C. to 80° C. and more preferably 40° C. to 60° C.

<Cathodic Electrolysis Treatment C1 (Treatment 1)>

The cathodic electrolysis treatment C1 is carried out to deposit chromium metal and a hydrated chromium oxide.

The electric quantity density (the product of the current density and the current application time) in the cathodic electrolysis treatment C1 is preferably 20 to 50 C/dm$^2$ and more preferably 25 to 45 C/dm$^2$ for the purpose of achieving a proper amount of deposition and ensuring an appropriate thickness of the base portion of the chromium metal layer.

The current density (unit: A/dm$^2$) and the current application time (unit: sec.) are suitably set based on the foregoing electric quantity density.

The cathodic electrolysis treatment C1 need not be continuous electrolysis treatment. In other words, the cathodic electrolysis treatment C1 may be intermittent electrolysis treatment because electrolysis is carried out separately for each set of electrodes in industrial production and accordingly, an immersion period with no current application is inevitably present. In the case of intermittent electrolysis treatment, the total electric quantity density preferably falls within the foregoing ranges.

<Anodic Electrolysis Treatment A1>

The anodic electrolysis treatment A1 serves to dissolve chromium metal deposited in the cathodic electrolysis treatment C1 so as to form the generation sites of the granular protrusions of the chromium metal layer to be generated in the cathodic electrolysis treatment C2.

When dissolution excessively proceeds in the anodic electrolysis treatment A1, this may cause a decreased number of generation sites and hence a lower number density of the granular protrusions per unit area, variation in distribution of the granular protrusions due to uneven progress of dissolution, and a small thickness of the base portion of the chromium metal layer of less than 7.0 nm.

Besides, when the current density of the anodic electrolysis treatment A1 is too high, this may adversely affect corrosion resistance and other properties. This is probably because part of the chromium metal layer is dissolved more than necessary, and accordingly, the generation sites with the base portion of the chromium metal layer having a thickness of less than 7.0 nm are locally formed.

The chromium metal layer formed through the cathodic electrolysis treatment C1 and the first anodic electrolysis treatment A1 is mainly the base portion. In order to have the base portion of the chromium metal layer with a thickness of 7.0 nm or more, it is necessary to ensure the chromium metal amount of not less than 50 mg/m$^2$ after the cathodic electrolysis treatment C1 and the first anodic electrolysis treatment A1.

Thus, in order to facilitate formation of the chromium metal layer having the granular protrusions in the subsequent cathodic electrolysis treatment C2, the current density of the anodic electrolysis treatment A1 (i.e., the current density of each of the anodic electrolysis treatments A1 that are carried out at least two times) is suitably adjusted, and is preferably not less than 0.1 A/dm$^2$ but less than 5.0 A/dm$^2$.

A current density of not lower than 0.1 A/dm$^2$ is favorable because this leads to formation of a sufficient number of generation sites of the granular protrusions, which makes it easy to sufficiently generate and uniformly distribute the granular protrusions in the subsequent cathodic electrolysis treatment C2.

A current density of less than 5.0 A/dm$^2$ is favorable because this leads to excellent rust resistance and under film corrosion resistance. This is probably because chromium metal is prevented from dissolving in an unnecessarily excessive amount in a single anodic electrolysis treatment, so that the generation sites of the granular protrusions do not excessively grow, thus preventing the base portion of the chromium metal layer from locally becoming thin.

The electric quantity density of the anodic electrolysis treatment A1 (i.e., the electric quantity density of each of the anodic electrolysis treatments A1 that are carried out at least two times) is preferably not less than 0.1 C/dm$^2$ but less than 5.0 C/dm$^2$. The lower limit of the electric quantity density in the anodic electrolysis treatment is preferably more than 0.3 C/dm$^2$. The upper limit of the electric quantity density in the anodic electrolysis treatment is preferably not more than 3.0 C/dm$^2$ and more preferably not more than 2.0 C/dm$^2$. The electric quantity density is a product of the current density and the current application time.

The current application time (unit: sec.) is suitably set based on the foregoing current density (unit: A/dm$^2$) and electric quantity density (unit: C/dm$^2$).

The anodic electrolysis treatment A1 need not be continuous electrolysis treatment. In other words, the anodic electrolysis treatment A1 may be intermittent electrolysis treatment because electrolysis is carried out separately for each set of electrodes in industrial production and accordingly, an immersion period with no current application is inevitably present. In the case of intermittent electrolysis treatment, the total electric quantity density preferably falls within the foregoing ranges.

<Cathodic Electrolysis Treatment C2>

As described above, cathodic electrolysis treatment is carried out to deposit chromium metal and a hydrated chromium oxide. In particular, the cathodic electrolysis treatment C2 allows the granular protrusions of the chromium metal layer to be generated at the foregoing generation sites serving as starting points. In this process, when the electric quantity density is too high, the granular protrusions of the chromium metal layer may excessively grow, leading to a coarse grain size.

For this reason, the electric quantity density of the cathodic electrolysis treatment C2 (i.e., the electric quantity density of each of the cathodic electrolysis treatments C2 that are carried out at least two times) is preferably less than 30.0 C/dm$^2$, more preferably not more than 25.0 C/dm$^2$ and even more preferably not more than 7.0 C/dm$^2$. The lower limit thereof is not particularly limited and is preferably not less than 1.0 C/dm$^2$ and more preferably not less than 2.0 C/dm$^2$.

The current density (unit: A/dm$^2$) and the current application time (unit: sec.) are suitably set based on the foregoing electric quantity density.

The cathodic electrolysis treatment C2 need not be continuous electrolysis treatment. In other words, the cathodic electrolysis treatment C2 may be intermittent electrolysis treatment because electrolysis is carried out separately for each set of electrodes in industrial production and accordingly, an immersion period with no current application is inevitably present. In the case of intermittent electrolysis treatment, the total electric quantity density preferably falls within the foregoing ranges.

<Number of Times of Treatment 2 including A1 and C2>

In the manufacturing method of the invention, the steel sheet having undergone the cathodic electrolysis treatment C1 is subjected to the treatment 2 including the anodic electrolysis treatment A1 and the cathodic electrolysis treatment C2 at least two times.

The number of times of the treatment 2 is preferably at least three, more preferably at least five and even more preferably at least seven. When the treatment 2 as above is repeated, this means that the formation of the generation sites of the granular protrusions of the chromium metal layer (anodic electrolysis treatment A1) and the formation of the granular protrusions of the chromium metal layer (cathodic electrolysis treatment C2) are repeated; therefore, the granular protrusions of the chromium metal layer can be uniformly formed at high density. Owing to this configuration, even when the coating weight of the hydrated chromium oxide layer is increased to improve corrosion resistance and other properties, the granular protrusions that are uniformly present at high density act to increase the number of contact points in welding, thus reducing contact resistance and achieving excellent weldability.

The upper limit of the number of times of the treatment 2 as above is not particularly limited; however, for the purpose of controlling the thickness of the base portion of the chromium metal layer formed in the cathodic electrolysis treatment C1 to a proper range, the treatment 2 is preferably not excessively repeated and is, for instance, repeated up to 30 times and preferably up to 20 times.

<Post-Treatment>

The treatment 2 including the anodic electrolysis treatment A1 and the cathodic electrolysis treatment C2 may be followed by post-treatment.

For example, in order to ensure paint adhesion and under film corrosion resistance, the steel sheet may be subjected to immersion treatment or cathodic electrolysis treatment using an aqueous solution containing a hexavalent chromium compound for the purposes of controlling the amount of hydrated chromium oxide layer, modifying that layer, and other purposes.

Even when the post-treatment as above is carried out, the thickness of the base portion of the chromium metal layer and the diameter and the number density of the granular protrusions are not affected thereby.

The hexavalent chromium compound contained in the aqueous solution used in the post-treatment is not particularly limited, and examples thereof include chromium trioxide ($CrO_3$), dichromates such as potassium dichromate ($K_2Cr_2O_7$), and chromates such as potassium chromate ($K_2CrO_4$).

EXAMPLES

The present invention is specifically described below with reference to examples. However, the present invention should not be construed as being limited to the following examples.

<Manufacture of Tin Mill Black Plate>

Each steel sheet (tempered grade: T4CA) as produced to a sheet thickness of 0.22 mm was subjected to normal degreasing and pickling. Subsequently, the relevant aqueous solution shown in Table 1 below was circulated by a pump at a rate equivalent to 100 mpm in a fluid cell, and electrolysis treatment was carried out using lead electrodes under the conditions shown in Table 2 below, thereby manufacturing a tin mill black plate that is TFS. The tin mill black plate as manufactured was rinsed with water and dried by a blower at room temperature.

To be more specific, first, the treatment 1 including the cathodic electrolysis treatment C1, and the treatment 2 including the anodic electrolysis treatment A1 and the cathodic electrolysis treatment C2 were carried out in this order by use of one of aqueous solutions A to D. The number of times of the treatment 2 was two or more, while the treatment 2 was carried out only once in some comparative examples. In some examples, the treatment 2 was followed by the post-treatment (cathodic electrolysis treatment) using an aqueous solution E.

As to the cases that the treatment including the anodic electrolysis treatment A1 and the cathodic electrolysis treatment C2 was carried out two or more times, the current density and the electric quantity density shown in Table 2 below were the values of each time.

For instance, in Example 1 (number of times of treatment 2: 2) shown in Table 2 below, the first cathodic electrolysis treatment C2 was carried out with a current density of 60.0 $A/dm^2$ and an electric quantity density of 9.0 $C/dm^2$, and the second cathodic electrolysis treatment C2 was carried out with a current density of 60.0 $A/dm^2$ and an electric quantity density of 9.0 $C/dm^2$.

<Coating Weight>

For each of the manufactured tin mill black plates, the coating weight of the chromium metal layer (Cr metal layer) and the coating weight of the hydrated chromium oxide layer (hydrated Cr oxide layer) in terms of chromium amount (stated simply as "Coating weight" in Table 3 below) were measured. The measurement methods are as described above. The results are shown in Table 3 below.

<Cr Metal Layer Structure>

For the Cr metal layer of each of the manufactured tin mill black plates, the thickness of the base portion and the maximum diameter and the number density per unit area of the granular protrusions were measured. The measurement methods are as described above. The results are shown in Table 3 below.

<Evaluation>

The manufactured tin mill black plates were evaluated for the following factors. The evaluation results are shown in Table 3 below.

«Rust Resistance 1: Rust Resistance Test of Abraded Steel Sheet»

A rust resistance test of an abraded steel sheet is conducted to evaluate rust resistance. Specifically, two samples were cut out from each of the manufactured tin mill black plates. One sample (30 mm×60 mm) was fixed to a rubbing tester for use as an evaluation sample, while the other sample (10 mm×10 mm) was fixed to a head, and the head was moved 10 strokes over a length of 60 mm at a surface pressure of 1 $kgf/cm^2$ and a rubbing rate of 1 second per reciprocation. Thereafter, the evaluation sample was allowed to stand in a constant temperature and humidity chamber at 40° C. and 80% RH for 7 days. Then, the evaluation sample was observed at low magnification with an optical microscope, and a micrograph thereof was subjected to image analysis to determine the rusting area fraction of a rubbed portion. The evaluation was made according to the following criteria. For practical use, when the result is A, B or C, the tin mill black plate can be rated as having excellent rust resistance.

A: A rusting area fraction of less than 1%

B: A rusting area fraction of not less than 1% but less than 2%

C: A rusting area fraction of not less than 2% but less than 5%

D: A rusting area fraction of not less than 5% but less than 10%

E: A rusting area fraction of not less than 10%, or rusting at somewhere other than a rubbed portion.

«Rust Resistance 2: Storage Rust Test»

Twenty samples of 100 mm×100 mm were cut out from each of the manufactured tin mill black plates, stacked, wrapped with anti-rust paper, sandwiched by pieces of plywood to be thereby fixed, and then allowed to stand in a constant temperature and humidity chamber at 30° C. and 85% RH for 2 months. Thereafter, the area fraction of rust that occurred on superposed surfaces (rust area fraction) was observed and evaluated according to the following criteria. For practical use, when the result is A, B or C, the tin mill black plate can be rated as having excellent rust resistance.

A: No rusting

B: A very little rusting or a rust area fraction of less than 0.1%

C: A rust area fraction of not less than 0.1% but less than 0.3%

D: A rust area fraction of not less than 0.3% but less than 0.5%

E: A rust area fraction of not less than 0.5%

«Surface Appearance (Color Tone)»

For each of the manufactured tin mill black plates, the L value was measured according to the Hunter-type color difference measurement defined in JIS Z 8730 of old version (1980) and evaluated according to the following criteria. For practical use, when the result is A, B or C, the tin mill black plate can be rated as having an excellent surface appearance.

A: An L value of not less than 69

B: An L value of not less than 67 but less than 69

C: An L value of not less than 65 but less than 67

D: An L value of not less than 63 but less than 65

E: An L value of less than 63

«Weldability (Contact Resistance)»

Each of the manufactured tin mill black plates was subjected to heat treatment of 210° C.×10 minutes two times, and then the contact resistance was measured. More specifically, samples of each tin mill black plate were heated (and retained at a target plate temperature of 210° C. for 10 minutes) in a batch furnace, and the samples having undergone the heat treatment were superposed. Subsequently, 1 mass % Cr—Cu electrodes of DR type were machined to a tip diameter of 6 mm and a curvature of R40 mm, the superposed samples were sandwiched by these electrodes and retained at a pressure of 1 kgf/cm$^2$ for 15 seconds, then 10 A current was supplied thereto, and the contact resistance between the sample plates was measured. The measurement was made for ten cases, and the average thereof was taken as a contact resistance value to be evaluated according to the following criteria. For practical use, when the result is AA, A, B or C, the tin mill black plate can be rated as having excellent weldability.

AA: Contact resistance of not more than 20μΩ

A: Contact resistance of more than 20μΩ but not more than 100μΩ

B: Contact resistance of more than 100μΩ but not more than 300μΩ

C: Contact resistance of more than 300μΩ but not more than 500μΩ

D: Contact resistance of more than 500μΩ but not more than 1000μΩ

E: Contact resistance of more than 1000μΩ

«Primary Paint Adhesion»

Each of the manufactured tin mill black plates was applied with epoxy-phenolic resin and subjected to heat treatment of 210° C.×10 minutes two times. Subsequently, cuts reaching the steel sheet were made at intervals of 1 mm in a grid pattern. Peeling was carried out using tape, and the peeling state was observed. The peeling area fraction was evaluated according to the following criteria. For practical use, when the result is A, B or C, the tin mill black plate can be rated as having excellent primary paint adhesion.

A: A peeling area fraction of 0%

B: A peeling area fraction of more than 0% but not more than 2%

C: A peeling area fraction of more than 2% but not more than 5%

D: A peeling area fraction of more than 5% but not more than 30%

E: A peeling area fraction of more than 30%

«Secondary Paint Adhesion»

Each of the manufactured tin mill black plates was applied with epoxy-phenolic resin and subjected to heat treatment of 210° C.×10 minutes two times. Subsequently, cuts reaching the steel sheet were made at intervals of 1 mm in a grid pattern, retort treatment was carried out at 125° C. for 30 minutes. After drying, peeling was carried out using tape, and the peeling state was observed. The peeling area fraction was evaluated according to the following criteria. For practical use, when the result is A, B or C, the tin mill black plate can be rated as having excellent secondary paint adhesion.

A: A peeling area fraction of 0%

B: A peeling area fraction of more than 0% but not more than 2%

C: A peeling area fraction of more than 2% but not more than 5%

D: A peeling area fraction of more than 5% but not more than 30%

E: A peeling area fraction of more than 30%

«Under Film Corrosion Resistance»

Each of the manufactured tin mill black plates was applied with epoxy-phenolic resin and subjected to heat treatment of 210° C.×10 minutes two times. A cross cut reaching the steel sheet was made, and the resulting tin mill black plate was immersed in a test solution that was a mixed aqueous solution of 1.5% citric acid and 1.5% NaCl at 45° C. for 72 hours. Immersion was followed by rinsing and drying, and then tape peeling was carried out. The peeled width (i.e., the total width of peeled portions extending to right and left from a cut portion) was measured at four places within 10 mm from the crossing point of the cross cut, and the average of measurements at the four places was obtained. The average of the peeled widths was defined as an under film corroded width and evaluated according to the following criteria. For practical use, when the result is A, B or C, the tin mill black plate can be rated as having excellent under film corrosion resistance.

A: A corroded width of not more than 0.2 mm

B: A corroded width of more than 0.2 mm but not more than 0.3 mm

C: A corroded width of more than 0.3 mm but not more than 0.4 mm

D: A corroded width of more than 0.4 mm but not more than 0.5 mm

E: A corroded width of more than 0.5 mm

TABLE 1

| Aqueous solution | Composition |
|---|---|
| A | $CrO_3$ 0.50 mol/L<br>NaF 0.20 mol/L |
| B | $CrO_3$ 0.75 mol/L<br>NaF 0.20 mol/L |
| C | $CrO_3$ 1.00 mol/L<br>NaF 0.20 mol/L |

TABLE 1-continued

| Aqueous solution | Composition |
|---|---|
| D | $CrO_3$ 0.50 mol/L<br>NaF 0.10 mol/L |
| E | $CrO_3$ 0.60 mol/L<br>$NH_4F$ 0.048 mol/L |

TABLE 2

| | Treatment 1 and Treatment 2 | | | | | | | |
|---|---|---|---|---|---|---|---|---|
| | | | Treatment 1 Cathodic electrolysis treatment C1 | | | Treatment 2 Anodic electrolysis treatment A1 | | |
| | Aqueous solution | Temp. ° C. | Current density A/dm$^2$ | Current application time sec. | Electric quantity density C/dm$^2$ | Current density A/dm$^2$ | Current application time sec. | Electric quantity density C/dm$^2$ |
| EX 1 | A | 45 | 60.0 | 0.65 | 39.0 | 1.0 | 0.50 | 0.5 |
| EX 2 | A | 45 | 60.0 | 0.65 | 39.0 | 2.0 | 0.50 | 1 |
| EX 3 | A | 45 | 60.0 | 0.65 | 39.0 | 4.0 | 0.50 | 2 |
| EX 4 | A | 45 | 60.0 | 0.65 | 39.0 | 2.0 | 0.50 | 1 |
| EX 5 | A | 45 | 60.0 | 0.65 | 39.0 | 2.0 | 0.50 | 1 |
| EX 6 | A | 45 | 60.0 | 0.65 | 39.0 | 2.0 | 0.50 | 1 |
| EX 7 | A | 45 | 60.0 | 0.65 | 39.0 | 2.0 | 0.50 | 1 |
| EX 8 | A | 45 | 60.0 | 0.65 | 39.0 | 2.0 | 0.50 | 1 |
| EX 9 | A | 45 | 60.0 | 0.65 | 39.0 | 2.0 | 0.50 | 1 |
| EX 10 | A | 45 | 60.0 | 0.65 | 39.0 | 1.0 | 0.50 | 0.5 |
| EX 11 | A | 45 | 60.0 | 0.65 | 39.0 | 2.0 | 0.50 | 1 |
| EX 12 | A | 45 | 60.0 | 0.65 | 39.0 | 2.0 | 0.50 | 1 |
| EX 13 | A | 45 | 60.0 | 0.65 | 39.0 | 2.0 | 0.50 | 1 |
| EX 14 | A | 45 | 60.0 | 0.65 | 39.0 | 2.0 | 0.50 | 1 |
| EX 15 | A | 45 | 60.0 | 0.65 | 39.0 | 2.0 | 0.50 | 1 |
| EX 16 | A | 45 | 60.0 | 0.65 | 39.0 | 2.0 | 0.50 | 1 |
| EX 17 | B | 45 | 60.0 | 0.50 | 30.0 | 1.0 | 0.50 | 0.5 |
| EX 18 | B | 45 | 60.0 | 0.50 | 30.0 | 2.0 | 0.50 | 1 |
| EX 19 | B | 45 | 60.0 | 0.30 | 18.0 | 4.0 | 0.50 | 2 |
| EX 20 | B | 45 | 60.0 | 0.50 | 30.0 | 2.0 | 0.50 | 1 |
| EX 21 | B | 45 | 60.0 | 0.50 | 30.0 | 2.0 | 0.50 | 1 |
| EX 22 | B | 45 | 60.0 | 0.50 | 30.0 | 2.0 | 0.50 | 1 |
| EX 23 | B | 45 | 60.0 | 0.50 | 30.0 | 2.0 | 0.50 | 1 |
| EX 24 | B | 45 | 60.0 | 0.50 | 30.0 | 2.0 | 0.50 | 1 |
| EX 25 | B | 45 | 60.0 | 0.50 | 30.0 | 2.0 | 0.50 | 1 |
| EX 26 | B | 45 | 60.0 | 0.50 | 30.0 | 2.0 | 0.50 | 1 |
| EX 27 | C | 45 | 60.0 | 0.50 | 30.0 | 1.0 | 0.50 | 0.5 |
| EX 28 | C | 45 | 60.0 | 0.50 | 30.0 | 2.0 | 0.50 | 1 |
| EX 29 | C | 45 | 60.0 | 0.50 | 30.0 | 4.0 | 0.50 | 2 |
| EX 30 | C | 45 | 60.0 | 0.50 | 30.0 | 2.0 | 0.50 | 1 |
| EX 31 | C | 45 | 60.0 | 0.50 | 30.0 | 2.0 | 0.50 | 1 |
| EX 32 | C | 45 | 60.0 | 0.50 | 30.0 | 2.0 | 0.50 | 1 |
| EX 33 | C | 45 | 60.0 | 0.50 | 30.0 | 2.0 | 0.50 | 1 |
| EX 34 | C | 45 | 60.0 | 0.50 | 30.0 | 2.0 | 0.50 | 1 |
| EX 35 | C | 45 | 60.0 | 0.50 | 30.0 | 2.0 | 0.50 | 1 |
| EX 36 | C | 45 | 60.0 | 0.50 | 30.0 | 2.0 | 0.50 | 1 |
| EX 37 | A | 45 | 60.0 | 0.65 | 39.0 | 0.5 | 0.50 | 0.25 |
| EX 38 | A | 45 | 60.0 | 0.65 | 39.0 | 1.5 | 0.50 | 0.75 |
| EX 39 | A | 45 | 60.0 | 0.65 | 39.0 | 1.8 | 0.50 | 0.9 |
| EX 40 | A | 45 | 60.0 | 0.65 | 39.0 | 3.0 | 0.50 | 1.5 |
| EX 41 | A | 45 | 60.0 | 0.65 | 39.0 | 4.5 | 0.50 | 2.25 |
| EX 42 | A | 45 | 60.0 | 0.65 | 39.0 | 4.5 | 0.50 | 2.25 |
| CE 1 | D | 45 | 60.0 | 0.50 | 30.0 | 2.0 | 0.50 | 1 |
| CE 2 | A | 45 | 60.0 | 0.70 | 42.0 | 2.0 | 0.50 | 1 |
| CE 3 | A | 45 | 60.0 | 0.20 | 12.0 | 2.0 | 0.50 | 1 |

TABLE 2-continued

| | Treatment 1 and Treatment 2 Treatment 2 | | | | Post-treatment | | | | |
|---|---|---|---|---|---|---|---|---|---|
| | Cathodic electrolysis treatment C2 | | | Number | | | Cathodic electrolysis treatment | | |
| | Current density A/dm$^2$ | Current application time sec. | Electric quantity density C/dm$^2$ | of times of treatment 2 | Aqueous solution | Temp. ° C. | Current density A/dm$^2$ | Current application time sec. | Electric quantity density C/dm$^2$ |
| EX 1 | 60.0 | 0.15 | 9.0 | 2 | — | — | — | — | — |
| EX 2 | 60.0 | 0.15 | 9.0 | 2 | — | — | — | — | — |
| EX 3 | 60.0 | 0.15 | 9.0 | 2 | — | — | — | — | — |
| EX 4 | 60.0 | 0.10 | 6.0 | 3 | — | — | — | — | — |
| EX 5 | 60.0 | 0.07 | 4.2 | 5 | — | — | — | — | — |
| EX 6 | 60.0 | 0.05 | 3.0 | 7 | — | — | — | — | — |
| EX 7 | 60.0 | 0.05 | 3.0 | 10 | — | — | — | — | — |
| EX 8 | 60.0 | 0.15 | 9.0 | 2 | E | 40 | 8 | 0.50 | 4.0 |
| EX 9 | 60.0 | 0.10 | 6.0 | 2 | E | 40 | 25 | 0.50 | 12.5 |
| EX 10 | 60.0 | 0.05 | 3.0 | 4 | E | 40 | 25 | 0.50 | 12.5 |
| EX 11 | 60.0 | 0.10 | 6.0 | 2 | E | 40 | 15 | 1.00 | 15.0 |
| EX 12 | 60.0 | 0.10 | 6.0 | 2 | E | 40 | 15 | 1.50 | 22.5 |
| EX 13 | 60.0 | 0.05 | 3.0 | 2 | E | 40 | 15 | 0.50 | 7.5 |
| EX 14 | 60.0 | 0.10 | 6.0 | 3 | E | 40 | 15 | 1.00 | 15.0 |
| EX 15 | 60.0 | 0.07 | 4.2 | 5 | E | 40 | 15 | 1.00 | 15.0 |
| EX 16 | 60.0 | 0.05 | 3.0 | 7 | E | 40 | 15 | 1.00 | 15.0 |
| EX 17 | 60.0 | 0.10 | 6.0 | 2 | — | — | — | — | — |
| EX 18 | 60.0 | 0.10 | 6.0 | 2 | — | — | — | — | — |
| EX 19 | 60.0 | 0.10 | 6.0 | 2 | — | — | — | — | — |
| EX 20 | 60.0 | 0.10 | 6.0 | 3 | — | — | — | — | — |
| EX 21 | 60.0 | 0.07 | 4.2 | 5 | — | — | — | — | — |
| EX 22 | 60.0 | 0.05 | 3.0 | 7 | — | — | — | — | — |
| EX 23 | 60.0 | 0.10 | 6.0 | 2 | E | 40 | 15 | 0.50 | 7.5 |
| EX 24 | 60.0 | 0.10 | 6.0 | 3 | E | 40 | 15 | 1.00 | 15.0 |
| EX 25 | 60.0 | 0.07 | 4.2 | 5 | E | 40 | 15 | 1.00 | 15.0 |
| EX 26 | 60.0 | 0.05 | 3.0 | 7 | E | 40 | 15 | 1.00 | 15.0 |
| EX 27 | 60.0 | 0.10 | 6.0 | 2 | — | — | — | — | — |
| EX 28 | 60.0 | 0.10 | 6.0 | 2 | — | — | — | — | — |
| EX 29 | 60.0 | 0.10 | 6.0 | 2 | — | — | — | — | — |
| EX 30 | 60.0 | 0.10 | 6.0 | 3 | — | — | — | — | — |
| EX 31 | 60.0 | 0.07 | 4.2 | 5 | — | — | — | — | — |
| EX 32 | 60.0 | 0.05 | 3.0 | 7 | — | — | — | — | — |
| EX 33 | 60.0 | 0.10 | 6.0 | 2 | E | 40 | 15 | 0.50 | 7.5 |
| EX 34 | 60.0 | 0.10 | 6.0 | 3 | E | 40 | 15 | 1.00 | 15.0 |
| EX 35 | 60.0 | 0.07 | 4.2 | 5 | E | 40 | 15 | 1.00 | 15.0 |
| EX 36 | 60.0 | 0.05 | 3.0 | 7 | E | 40 | 15 | 1.00 | 15.0 |
| EX 37 | 60.0 | 0.15 | 9.0 | 2 | — | — | — | — | — |
| EX 38 | 60.0 | 0.15 | 9.0 | 2 | — | — | — | — | — |
| EX 39 | 60.0 | 0.15 | 9.0 | 2 | — | — | — | — | — |
| EX 40 | 60.0 | 0.15 | 9.0 | 2 | — | — | — | — | — |
| EX 41 | 60.0 | 0.15 | 9.0 | 2 | — | — | — | — | — |
| EX 42 | 60.0 | 0.10 | 6.0 | 3 | — | — | — | — | — |
| CE 1 | 60.0 | 0.25 | 15.0 | 1 | — | — | — | — | — |
| CE 2 | 60.0 | 0.15 | 9.0 | 1 | E | 40 | 15 | 0.50 | 7.5 |
| CE 3 | 60.0 | 0.30 | 18.0 | 1 | — | — | — | — | — |

EX: Example
CE: Comparative example

TABLE 3

| | Coating weight | | Cr metal layer structure | | | Evaluation | | | | | | |
|---|---|---|---|---|---|---|---|---|---|---|---|---|
| | Cr metal layer mg/m$^2$ | Hydrated Cr oxide layer mg/m$^2$ | Base portion Thickness nm | Granular protrusions Maximum diameter nm | Granular protrusions Density Protrusions/μm$^2$ | Rust resistance 1 | Rust resistance 2 | Surface appearance | Weld-ability | Primary paint adhesion | Secondary paint adhesion | Under film corrosion resistance |
| EX 1 | 135 | 4 | 11.8 | 65 | 300 | A | A | A | A | A | B | C |
| EX 2 | 125 | 4 | 10.5 | 70 | 270 | A | B | B | A | A | B | C |
| EX 3 | 115 | 4 | 10.1 | 80 | 240 | A | B | C | A | A | B | C |
| EX 4 | 115 | 5 | 10.0 | 40 | 400 | A | B | A | A | A | B | C |
| EX 5 | 110 | 5 | 10.5 | 30 | 650 | A | B | A | A | A | B | C |
| EX 6 | 110 | 5 | 10.8 | 30 | 1050 | A | B | A | AA | A | B | C |
| EX 7 | 150 | 5 | 11.5 | 20 | 1300 | A | B | A | AA | A | B | C |

TABLE 3-continued

| | Coating weight | | Cr metal layer structure | | | Evaluation | | | | | | |
|---|---|---|---|---|---|---|---|---|---|---|---|---|
| | Cr metal layer mg/m² | Hydrated Cr oxide layer mg/m² | Base portion Thickness nm | Granular protrusions Maximum diameter nm | Granular protrusions Density Protrusions/μm² | Rust resistance 1 | Rust resistance 2 | Surface appearance | Weld-ability | Primary paint adhesion | Secondary paint adhesion | Under film corrosion resistance |
| EX 8 | 140 | 11 | 10.5 | 65 | 280 | A | B | C | A | A | A | B |
| EX 9 | 115 | 18 | 10.8 | 50 | 300 | A | B | B | A | A | A | A |
| EX 10 | 118 | 19 | 10.9 | 50 | 350 | A | A | C | A | A | A | A |
| EX 11 | 115 | 22 | 10.8 | 50 | 310 | A | B | B | A | A | A | A |
| EX 12 | 115 | 28 | 10.9 | 50 | 330 | A | B | B | A | A | A | A |
| EX 13 | 110 | 17 | 10.4 | 35 | 210 | A | B | A | A | A | A | A |
| EX 14 | 115 | 20 | 10.0 | 40 | 400 | A | B | A | A | A | A | A |
| EX 15 | 110 | 19 | 10.5 | 30 | 650 | A | B | A | A | A | A | A |
| EX 16 | 110 | 19 | 10.8 | 30 | 1050 | A | B | A | M | A | A | A |
| EX 17 | 130 | 4 | 12.5 | 60 | 310 | A | A | A | A | A | B | C |
| EX 18 | 126 | 5 | 11.5 | 70 | 290 | A | B | B | A | A | B | C |
| EX 19 | 105 | 4 | 7.8 | 85 | 250 | C | C | B | A | A | C | C |
| EX 20 | 110 | 5 | 10.5 | 40 | 450 | A | B | A | A | A | B | C |
| EX 21 | 105 | 5 | 11.0 | 30 | 700 | A | B | A | A | A | B | C |
| EX 22 | 120 | 5 | 12.0 | 30 | 1100 | A | B | A | M | A | B | C |
| EX 23 | 127 | 17 | 11.4 | 70 | 290 | A | B | C | A | A | A | A |
| EX 24 | 110 | 21 | 10.5 | 40 | 450 | A | B | A | A | A | A | A |
| EX 25 | 110 | 20 | 11.0 | 30 | 700 | A | B | A | A | A | A | A |
| EX 26 | 120 | 20 | 12.0 | 30 | 1100 | A | B | A | AA | A | A | A |
| EX 27 | 134 | 5 | 13.5 | 60 | 300 | A | A | A | A | A | B | C |
| EX 28 | 129 | 4 | 12.0 | 68 | 290 | A | B | B | A | A | C | C |
| EX 29 | 124 | 5 | 11.2 | 80 | 230 | A | B | B | A | A | C | C |
| EX 30 | 130 | 5 | 11.5 | 40 | 500 | A | B | A | A | A | B | C |
| EX 31 | 135 | 5 | 12.0 | 30 | 800 | A | B | A | A | A | B | C |
| EX 32 | 145 | 5 | 13.0 | 30 | 1200 | A | B | A | AA | A | B | C |
| EX 33 | 128 | 18 | 11.9 | 70 | 280 | A | A | B | A | A | A | A |
| EX 34 | 130 | 21 | 11.5 | 40 | 550 | A | A | A | A | A | A | A |
| EX 35 | 135 | 20 | 12.3 | 30 | 850 | A | A | A | A | A | A | A |
| EX 36 | 145 | 20 | 13.2 | 25 | 1250 | A | A | A | AA | A | A | A |
| EX 37 | 112 | 5 | 10.8 | 50 | 350 | A | A | A | A | A | B | C |
| EX 38 | 116 | 5 | 10.5 | 60 | 310 | A | A | B | A | A | B | C |
| EX 39 | 118 | 4 | 10.6 | 65 | 290 | A | A | B | A | A | B | C |
| EX 40 | 115 | 4 | 10.1 | 75 | 260 | A | B | C | A | A | B | C |
| EX 41 | 110 | 4 | 10.0 | 90 | 200 | A | C | C | A | A | B | C |
| EX 42 | 116 | 4 | 10.5 | 60 | 300 | A | C | B | B | A | B | C |
| CE 1 | 120 | 5 | 10.7 | 150 | 21 | A | B | E | D | A | D | C |
| CE 2 | 100 | 18 | 13.0 | 30 | 25 | A | A | A | D | A | A | A |
| CE 3 | 95 | 5 | 5.9 | 120 | 29 | E | E | E | D | A | A | C |

EX: Example
CE: Comparative example

As is evident from the results shown in Table 3, it was revealed that the tin mill black plates of Examples 1 to 42 were excellent in weldability and also in rust resistance, under film corrosion resistance and (primary and secondary) paint adhesions. In contrast, the tin mill black plates of Comparative Examples 1 to 3 exhibited insufficient weldability, and some comparative examples were insufficient in rust resistance and/or paint adhesion.

REFERENCE SIGNS LIST

1: tin mill black plate
2: steel sheet
3: chromium metal layer
3*a*: base portion
3*b*: granular protrusion
4: hydrated chromium oxide layer

The invention claimed is:

1. A tin mill black plate comprising, on a surface of a steel sheet, a chromium metal layer and a hydrated chromium oxide layer stacked in this order from a steel sheet side, wherein the chromium metal layer has a coating weight in a range of 65 to 200 mg/m², the hydrated chromium oxide layer has a coating weight in a range of 3 to 30 mg/m² in terms of chromium amount, and the chromium metal layer includes a base portion with a thickness of not less than 7.0 nm and granular protrusions provided on the base portion and having a maximum diameter of not more than 100 nm and a number density per unit area of not less than 1,000 protrusions/μm².

2. The tin mill black plate according to claim 1, wherein the hydrated chromium oxide layer has a coating weight in a range of more than 15 mg/m² but not more than 30 mg/m² in terms of chromium amount.

3. A tin mill black plate manufacturing method for obtaining the tin mill black plate according to claim 1 by use of an aqueous solution that contains Cr in an amount of not less than 0.50 mol/L and F in an amount of more than 0.10 mol/L and is free of sulfuric acid except for sulfuric acid inevitably incorporated therein, the method comprising:

a step of subjecting a steel sheet to treatment 1 including cathodic electrolysis treatment C1 using the aqueous solution; and a step of subjecting the steel sheet having undergone the cathodic electrolysis treatment C1 to treatment 2 including anodic electrolysis treatment A1 and cathodic electrolysis treatment C2 following the anodic electrolysis treatment A1, using the aqueous solution, at least two times.

4. The tin mill black plate manufacturing method according to claim 3, wherein a current density of the anodic electrolysis treatment A1 is in a range of not less than 0.1 $A/dm^2$ but less than 5.0 $A/dm^2$, and an electric quantity density of the anodic electrolysis treatment A1 is in a range of not less than 0.1 $C/dm^2$ but less than 5.0 $C/dm^2$.

5. The tin mill black plate manufacturing method according to claim 3, wherein the aqueous solution used in the cathodic electrolysis treatment C1, the anodic electrolysis treatment A1, and the cathodic electrolysis treatment C2 comprises only one type of aqueous solution.

6. The tin mill black plate manufacturing method according to claim 4, wherein the aqueous solution used in the cathodic electrolysis treatment C1, the anodic electrolysis treatment A1, and the cathodic electrolysis treatment C2 comprises only one type of aqueous solution.

* * * * *